United States Patent [19]

Weedman

[11] Patent Number: 5,020,804

[45] Date of Patent: Jun. 4, 1991

[54] PSYCHOLOGY GAME

[76] Inventor: Gail H. Weedman, 607 Tumbleweed Ct., Kokomo, Ind. 46901

[21] Appl. No.: 537,915

[22] Filed: Jun. 13, 1990

[51] Int. Cl.[5] ..... A63F 3/00

[52] U.S. Cl. ..... 273/249; 273/148 R

[58] Field of Search ..... 273/249, 248, 243, 296, 273/236, 148 R

[56] References Cited

U.S. PATENT DOCUMENTS

| | | | |
|---|---|---|---|
| 4,682,956 | 7/1987 | Krane | 273/243 |
| 4,872,681 | 10/1989 | Martin | 273/118 R |
| 4,893,819 | 1/1990 | Wright | 273/243 |

FOREIGN PATENT DOCUMENTS

| | | | |
|---|---|---|---|
| 2126908 | 4/1984 | United Kingdom | 273/236 |

*Primary Examiner*—Benjamin Layno

*Attorney, Agent, or Firm*—Woodard, Emhardt, Naughton, Moriarty & McNett

[57] ABSTRACT

A method of playing a psychology game with one or more players wherein the one or more players are provided with a hypothetical person having at least one undisclosed character trait, a description of a circumstance with which the hypothetical person is confronted, a plurality of descriptions of possible reactions of the hypothetical person to the circumstance, and a means for determining the quality of the player's reaction selection, the means includes providing to the player a performance rating for the player's reaction selection wherein the performance rating is based upon the at least one undisclosed character trait. The method comprises the steps of: (1) selecting as most appropriate one of the plurality of descriptions of possible reactions, (2) determining the quality of the player's reaction selection in the reaction selection step, and (3) rewarding the one or more players with a game benefit in proportion to the quality of the player's reaction selection determined in the quality determining step, whereby the determination of the at one undisclosed character trait of the hypothetical person increases a player's ability to determine the most appropriate selection in the reaction selection step.

18 Claims, 3 Drawing Sheets

| 2 | 3 | 4 |
|---|---|---|
| A FEW WEEKS AFTER MARY'S (JANE'S) MOTHER REMARRIES HER STEPDAD SAYS, "YOU CAN CALL ME DAD." | WHEN MARY (JANE) TELLS HER DAD SHE GOT AN (A) IN MATH, HE NODS AND CONTINUES READING THE PAPER. | MARY'S (JANE'S) STEPSISTER SAYS, "YOUR MOTHER TREATS YOU BETTER THAN SHE TREATS ME." |

PSYCHOLOGY GAME

BACKGROUND OF THE INVENTION

This invention relates generally to a method of playing a psychology game.

Games involving the use of psychological skills are known in the prior art. For example, my U.S. Pat. No. 3,124,358 discloses a psychology game in which players try to select the most appropriate reaction of a hypothetical person to a given circumstance from a plurality of different given reactions to the given circumstance and therefore acquire for that selection the most advantageous game value. The appropriateness of the various possible given reactions are predetermined on the basis of the friendliness of the hypothetical person.

The above game assigns ratings to the various responses on the basis whether the hypothetical person is friendly or unfriendly. This feature of the above game is somewhat restrictive however in that there exists a wide variety of physical, mental, emotional, social and moral character traits that affect a person's psychological development and accordingly influence that person's reactions to various circumstances.

Another aspect of my earlier game is that the character trait assigned to the hypothetical person is disclosed at the outset of the game so that such character trait may help the players determine the most appropriate reaction of the hypothetical person to the given circumstance. It is perceived that if certain character traits of the hypothetical person are left unknown for the players to discover, an additional challenge will be provided thus making the game more fun and exciting.

SUMMARY OF THE INVENTION

One embodiment of the present invention involves a method of playing a psychology game with one or more players wherein the one or more players are provided with a hypothetical person having at least one undisclosed character trait, a description of a circumstance with which the hypothetical person is confronted, a plurality of descriptions of possible reactions of the hypothetical person to the circumstance, and a means for determining the quality of the player's reaction selection, the means includes providing to the player a performance rating for the player's reaction selection wherein the performance rating is based upon the at least one undisclosed character trait. The method comprises the steps of: (1) selecting as most appropriate one of the plurality of descriptions of possible reactions, (2) determining the quality of the player's reaction selection in the reaction selection step, and (3) rewarding the one or more players with a game benefit in proportion to the quality of the player's reaction selection determined in the quality determining step, whereby the determination of the at least one undisclosed character trait of the hypothetical person increases a player's ability to determine the most appropriate selection in the reaction selection step.

One object of the present invention is to provide an improved psychology game.

Another object of the present invention is to provide a psychology game which provides ratings of a player's performance which are reasonably accurate.

Other objects and benefits of the present invention can be discerned from the following written description and accompanying drawings.

BRIEF DESCRIPTION OF THE DRAWINGS

In FIG. 1, the two circular portions are not identical in order to better illustrate how the spiral is plotted. In an actual game, the two circular portions will look alike except for the performance rating numbers visible through the window means.

FIG. 2 shows the embodiment of FIG. 1 except that a series of holes is shown on a spiral curve in FIG. 2 instead of the spiral slot shown in FIG. 1.

DESCRIPTION OF THE PREFERRED EMBODIMENT

Figure 1:
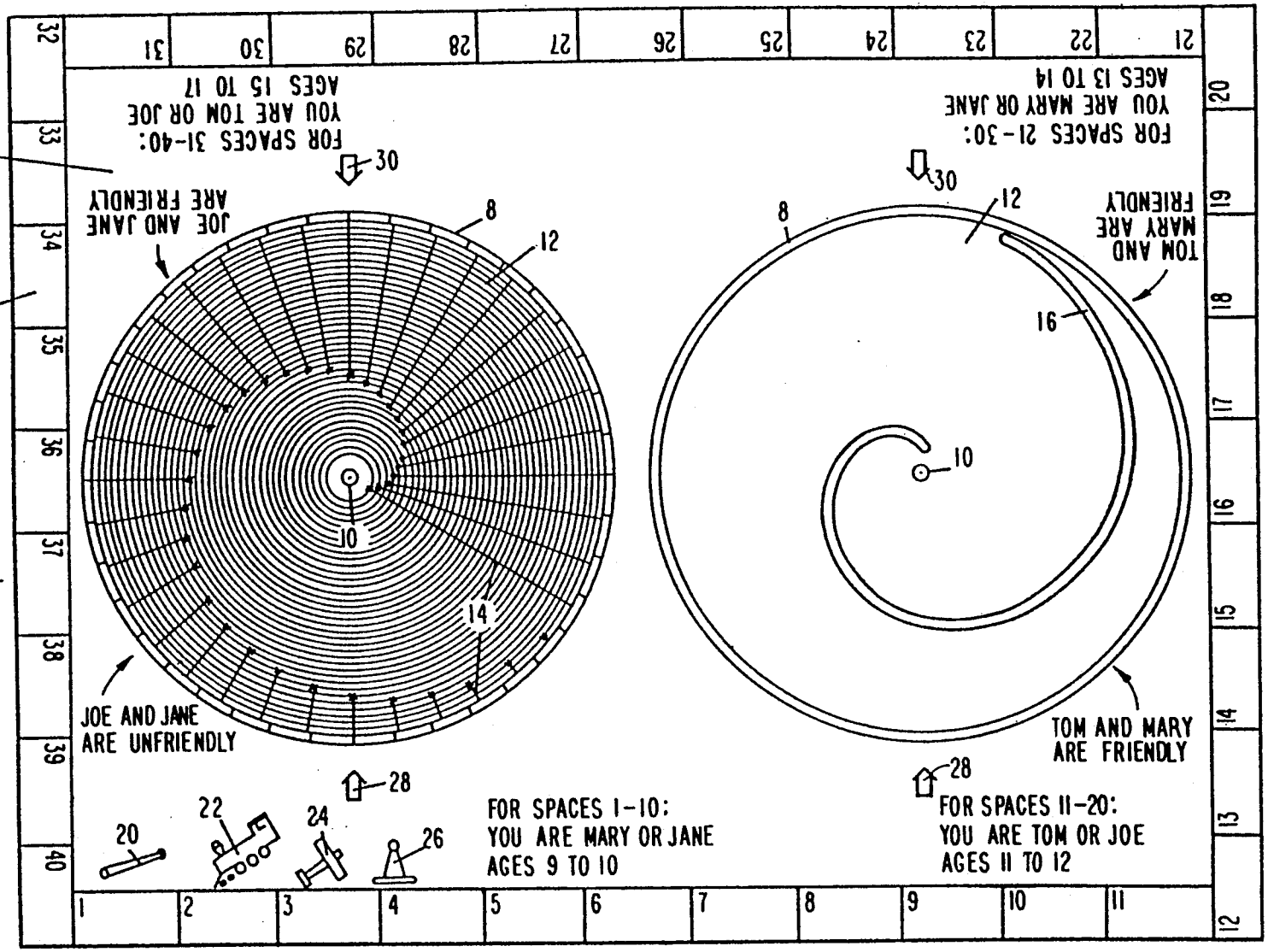
FIG. 1 is an elevational view of the game board of the present invention. Certain index numbers which appear in other figures are omitted from FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated methods, and such further applications of the principles of the invention as illustrated therein being contemplated as would normally occur to one skilled in the art to which the invention relates.

Figure 2:
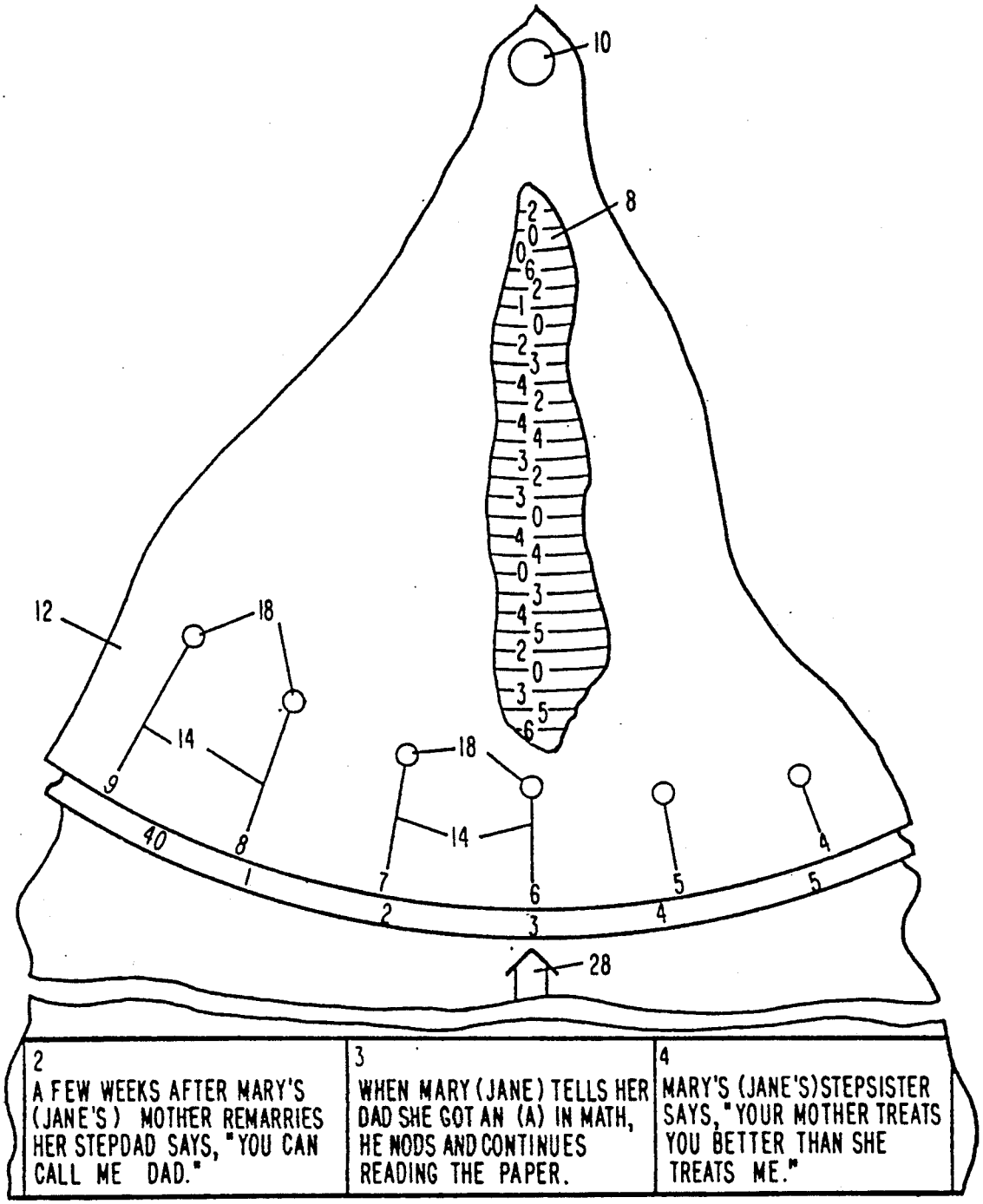
FIG. 2 is an enlarged fragmentary elevational view of a portion of the game board of the present invention with parts broken away for ease of understanding and describing the invention.

Referring now to FIGS. 1 and 2, there is illustrated a game board 2. Around the edge of board 2 is a playing track indicated generally at 4 divided into a plurality of rectangular shaped playing spaces. In order to give the players some indication of progress along the track, the spaces can be and preferably are sequentially numbered. Thus, the playing track provides a ready indicator of the cumulative total of each player's performance ratings which will be described in detail later herein.

Figure 3:
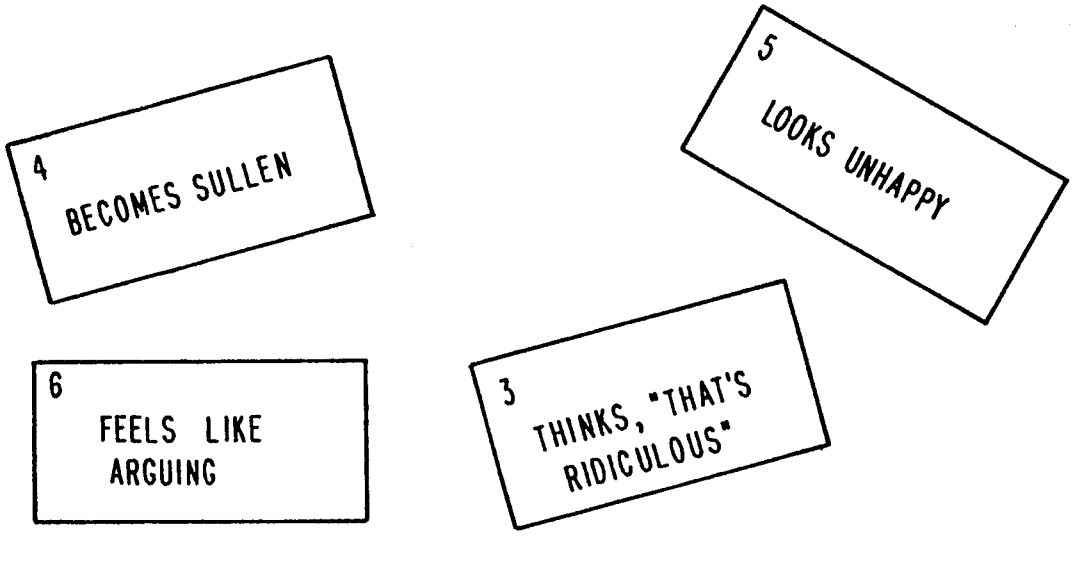
FIG. 3 is an elevational view of four typical loose pieces forming a part of the mechanism of the present invention, the pieces illustrated in FIG. 3 preferably taking the form of cards.

Each of the playing spaces has indicia printed thereon which will now be described. A plurality of descriptions of hypothetical situations or circumstances are provided in the game which taken together constitute a predetermined grouping of variables. A plurality of descriptions of possible reactions to these situations or circumstances are also provided which taken together constitute another predetermined grouping of variables. One grouping of variables is set forth in the playing track 4, in which case each playing space sets forth one of the variables of the particular grouping concerned. Examples of the circumstance and reaction variables are shown in FIGS. 2 and 3 respectively. As shown in FIG. 1, the circumstance variables are set forth in the playing track and correspond to four hypothetical persons identified as "Mary," "Jane," "Tom" and "Joe." Further, the playing track is divided into segments corresponding to different ones of the four hypothetical persons and further divided into circumstances corresponding to different age periods in the lives of the hypothetical personalities. For example, it is specified on game board 2 that the hypothetical persons "Mary" and "Jane" are ages 9 to 10 for the spaces one through ten, and that the same hypothetical persons are ages 13 to 14 for spaces 21 through 30. Further, circumstances corresponding to hypothetical girls "Mary" and "Jane" are dedicated to playing spaces 1-10 and 21-30 whereas playing spaces 11-20 and 31-40 are dedicated to circumstances corresponding to hypothetical boys "Tom" and "Joe."

The other grouping of variables (i.e. reaction variables) is provided in the loose pieces, preferably in the form of cards as shown in FIG. 3. Again, the representation of these variables are preferably written and are shown as such in FIG. 3. It will of course be understood that either groupings of variables can be set forth in the playing track, and the other grouping will then be set forth in the loose pieces or cards.

As will be described later in more detail, each player must select from the cards in his possession the most appropriate reaction to the circumstance confronting a certain hypothetical person. The game provides a performance rating for each pairing of a description of a reaction with a description of a circumstance. The performance ratings are established by an expert or a panel of experts who preferably are professional psychologists. More specifically, the expert or experts have evaluated the various physical, mental, emotional, social and moral character traits which have been assigned to the hypothetical persons and determined the appropriateness of each of a plurality of responses of the hypothetical persons to a given circumstance. It should be noted that in order to make the performance ratings reasonably accurate for a given reaction-circumstance pairing, it is desirable to assign a significant number of character traits to the hypothetical person. This provides the expert or experts with a good basis to judge the appropriateness of the hypothetical person's reaction to a given circumstance and therefore obtain a reasonably accurate set of performance rating numbers for each of the reaction-circumstance pairings.

The following is an exemplary list of character traits of the present improved psychology game that are assigned to the four hypothetical persons at two distinct age ranges of their lives:

Character Traits of Mary (Age 9 to 10): Caucasian; healthy; average height; average weight; rather pretty; friendly; outgoing; extrovert; laughs spontaneously; acts negatively to criticism; likes to tease and does not act negatively to being teased; sharing; has liberal Protestant parents; participates in school activities such as games, plays and musical programs; enjoys movies, cartoons and children's television programs; adjusting fairly well to school; average student; likes mother, stepdad, brother and sister; and is dishonest.

Character Traits of Mary (Age 13 to 14):

Same basic character traits as stated above but maturing; laughter not as spontaneous; discovered her musical talents; enjoys parties; thinks dating may be fun; more selective in school activities; grades are improving; worked as an assistant at a Girl Scout camp; learning to be flexible; rather easygoing; and family relationships are good.

Character Traits of Jane (Age 9 to 10):

Caucasian; unfriendly; introvert; somewhat shy; average appearance; enjoys television and movies; tall for age; slender; possesses one good friend and several casual friends; intelligent; achieves good grades; acts negatively to criticism and sometime sulks in response thereto; acts negatively to teasing; feelings are hurt easily; prefers privacy; prefers to have her own way; active in Girl Scouts; does not like to accept leadership positions; participates in a few school activities; possessive of toys; talks loudly when angry; likes to compete with brother and stepsister; thinks stepfather is OK but resents his taking her paternal father's place in the family; her family attends Protestant church; and is honest.

Character Traits of Jane (Age 13 to 14):

Same basic character traits as stated above but maturing; still making good grades; rather easily upset; thinks her parents do not understand her; self-centered; somewhat selfish; no longer sulks but complains frequently; does not like unpleasant tasks; procrastinates; insecure; moody; holds grudges; her best friend's father is a medical doctor and she thinks that is a neat profession.

Character Traits of Tom (Age 11 to 12):

Caucasian; friendly; outgoing; extrovert; somewhat attractive; average height; average weight; enjoys being a showoff; enjoys teasing; usually accepts teasing from friends; possesses several good friends; generous; laughs readily; knows that his parents like him; likes family and home; considers parental discipline normal; enjoys playing softball and football with friends; enjoyed past attendance at basketball camp; slow temper; intelligent; enjoys school; occasionally earns an (A) grade in school but is too busy for much homework; parents are members of staunch Protestant church; prejudiced; and lazy.

Character Traits of Tom (Age 15 to 17):

Same basic character traits as above but maturing; a little overweight; finds overweight girls attractive; selective in school activities; seldom depressed or moody; considers himself honest; somewhat tolerant; enjoys parties; enjoys dating; seldom holds a grudge; saving for college; aspires to be a physical education instructor; achieves average grades; and is conservative.

Character Traits of Joe (Age 11 to 12):

Unfriendly; introvert; shy; relatively short; overweight; mildly awkward; homely and is cognizant of such fact; self-conscious about weight and appearance; quiet; reserved; likes to have his way; acts negatively to criticism and sometimes sulks and becomes angry in response thereto; possesses two good friends; acts negatively to nagging; considers himself honest; holds a grudge; possesses a quick temper; does not like to share his possessions; insecure; intelligent but does not apply himself; earned an (A) grade in school merely to prove he has the ability to make good grades; participates in a few school activities; member of the Catholic church; not prejudiced; and industrious.

Character Traits of Joe (Age 15 to 17):

Same basic character traits as above but maturing, however: still self-conscious about looks; a little overweight but has good coordination; has the ability to play basketball and football fairly well; mildly moody; becoming forceful and emphatic; developing a sense of self and what he desires to accomplish in life; tries to control temper; possessive; self-centered; mildly selfish; holds a grudge one day; thorough and efficient when he desires to be so; attends a few parties; believes his father is unfair; avid reader of science books and magazines; and aspires to be a medical doctor but has erratic study habits.

In the preferred embodiment of the game, a listing of the character traits of all of the hypothetical persons (i.e. a master profile chart) is provided in the directions of the game. However, it is a key feature of the present invention that the listing does not disclose to the players of the game which specific character traits are assigned to each of the hypothetical persons. By not disclosing the specific character trait assignment, the players will attempt to discover the such assignment in order to help them determine the most appropriate reaction of the respective hypothetical person to the given circumstance. The above feature will provide additional challenge to the game thus making the game more fun and exciting.

An example of a master profile chart as referred to above is as follows:

1. Outgoing, not shy
2. Shy
3. Introvert
4. Extrovert
5. Generous
6. Selfish, possessive
7. Conservative and somewhat narrow minded
8. Feels insecure
9. Quick tempered
10. When angry, may respond by hitting
11. Tolerant and easy going
12. Criticism causes problems; may sulk
13. Feelings easily hurt
14. Likes to tease and does not mind being teased
15. Will not tolerate teasing
16. Holds a grudge
17. Likes to have own way
18. Good family relationships
19. Thinks father is unfair
20. Thinks parents do not understand him/her
21. Likes mother, stepfather, brother and sister
22. Thinks stepfather is OK but resents his taking father's place in the family
23. Competes with brother and sister
24. Saving for college
25. Avid reader of science books and news magazines
26. Hopes to be a medical doctor but has erratic study habits
27. Hopes to be a physical education instructor
28. Mother is of a different race and color
29. Honest
30. Dishonest
31. Prejudiced
32. Not prejudiced
33. Lazy
34. Industrious As the game proceeds and the players analyze the rating value of reactions of each of the hypothetical persons to the various given circumstances, the players may indicate on a piece of paper provided to them (i.e. a character profile card), which of the above character traits they believe were assigned to each of the hypothetical persons. An example of a partially filled out character profile card of a player is as follows:

| Jane | Tom | Mary | Joe |
|---|---|---|---|
| Unfriendly | Friendly | Friendly | Unfriendly |
| Honest | Prejudiced | Dishonest | Not Prejudiced |
| | Lazy | Extrovert | Industrious |

In order to initiate the players' development of their respective character profile chart, an asterisk ("*") may be placed immediately after some of the descriptions of circumstances which appear on playing track 4. The asterisk will refer a player to the rules of the game where the following is printed:

(*) Is it Mary or Jane who is honest?
(*) Is it Mary or Jane who is dishonest?
(*) Is it Tom or Joe who is prejudiced?
(*) Is it Tom or Joe who is not prejudiced?
(*) Is it Tom or Joe who is lazy?
(*) Is it Tom or Joe who is industrious?

If a player lands on a description of a circumstance which has an asterisk following thereafter, that player should attempt to fill in one of the character traits on his character profile card after he receives a performance rating for his selection of a reaction of a hypothetical person to the given circumstance. It should be noted that the above questions provided in the rules help the player focus upon which character trait is being concentrated upon in the given circumstance.

An alternative way of playing the game would be to not provide a master profile chart giving all the character traits of the hypothetical persons to the players of the game. In this way, the players may attempt to develop their own listing of character traits on their respective master profile card that they believe are possessed by each of the hypothetical persons without the benefit of having the aggregate listing of possible character traits (i.e. the master profile chart). The above may add further challenge to the game.

As alluded to above, the advantage of the players developing a listing of character traits (i.e. a character profile card) of each of the hypothetical person is that a player can use this information as the game proceeds to make more informed selections of the reactions of the hypothetical persons to the given circumstances and thus achieve higher performance ratings for those selections.

As discussed above, performance ratings have been assigned with expert assistance for each of the various reactions to each of the given circumstances. The performance ratings can be set forth in tabular form, and examples of performance ratings corresponding to 40 circumstances and 36 reactions are set forth below:

TOM AND MARY ARE FRIENDLY
Circumstances 1 to 20

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | 4 | 1 | 2 | 1 | 1 | 2 | 4 | 0 | 3 | 5 | 0 | 4 | 4 | 2 | 4 | 2 | 2 | 4 | 4 | 1 |
| 2 | 2 | 2 | 4 | 2 | 1 | 2 | 4 | 0 | 2 | 2 | 2 | 1 | 2 | 2 | 3 | 3 | 3 | 2 | 3 | 2 |
| 3 | 3 | 2 | 2 | 5 | 1 | 4 | 4 | 1 | 1 | 5 | 0 | 4 | 5 | 3 | 5 | 3 | 3 | 4 | 4 | 2 |
| 4 | 0 | 1 | 3 | 1 | 0 | 1 | 1 | 0 | 1 | 2 | 0 | 1 | 0 | 0 | 1 | 0 | 0 | 1 | 1 | 1 |
| 5 | 1 | 2 | 5 | 5 | 2 | 6 | 5 | 0 | 1 | 5 | 0 | 5 | 2 | 2 | 6 | 3 | 2 | 3 | 6 | 5 |
| 6 | 3 | 1 | 4 | 5 | 2 | 6 | 4 | 0 | 1 | 5 | 0 | 3 | 3 | 2 | 4 | 2 | 1 | 0 | 4 | 2 |
| 7 | 0 | 1 | 3 | 1 | 2 | 4 | 4 | 0 | 1 | 3 | 0 | 3 | 1 | 0 | 2 | 0 | 0 | 0 | 2 | 1 |
| 8 | 2 | 6 | 4 | 4 | 2 | 4 | 6 | 1 | 4 | 4 | 0 | 6 | 4 | 2 | 4 | 2 | 2 | 1 | 5 | 1 |
| 9 | 0 | 1 | 6 | 6 | 3 | 4 | 5 | 0 | 2 | 6 | 1 | 2 | 4 | 1 | 5 | 2 | 2 | 2 | 4 | 2 |
| 10 | 3 | 3 | 6 | 5 | 2 | 5 | 4 | 0 | 3 | 6 | 1 | 4 | 3 | 2 | 4 | 2 | 2 | 2 | 6 | 2 |
| 11 | 1 | 2 | 2 | 2 | 3 | 5 | 5 | 2 | 2 | 4 | 2 | 3 | 5 | 5 | 3 | 4 | 4 | 5 | 2 | 3 |
| 12 | 6 | 3 | 2 | 2 | 6 | 1 | 1 | 3 | 5 | 1 | 5 | 1 | 6 | 4 | 1 | 5 | 5 | 5 | 1 | 6 |
| 13 | 0 | 0 | 1 | 0 | 2 | 3 | 2 | 1 | 1 | 4 | 0 | 1 | 1 | 0 | 3 | 0 | 0 | 1 | 3 | 1 |
| 14 | 1 | 1 | 1 | 2 | 1 | 5 | 3 | 0 | 1 | 6 | 0 | 3 | 1 | 0 | 2 | 0 | 0 | 1 | 4 | 2 |

-continued

TOM AND MARY ARE FRIENDLY
Circumstances 1 to 20

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 15 | 4 | 5 | 1 | 3 | 6 | 5 | 3 | 6 | 5 | 4 | 6 | 3 | 4 | 5 | 4 | 2 | 2 | 1 | 3 | 5 |
| 16 | 2 | 2 | 4 | 4 | 3 | 3 | 5 | 2 | 1 | 4 | 0 | 5 | 2 | 3 | 4 | 2 | 3 | 3 | 5 | 1 |
| 17 | 6 | 1 | 0 | 2 | 5 | 1 | 1 | 5 | 6 | 1 | 4 | 1 | 6 | 6 | 2 | 5 | 6 | 6 | 1 | 6 |
| 18 | 2 | 3 | 3 | 3 | 4 | 4 | 4 | 1 | 3 | 3 | 0 | 2 | 3 | 2 | 3 | 3 | 2 | 4 | 5 | 4 |
| 19 | 3 | 4 | 4 | 6 | 4 | 5 | 6 | 1 | 3 | 5 | 2 | 6 | 4 | 3 | 6 | 4 | 4 | 4 | 5 | 5 |
| 20 | 6 | 4 | 1 | 4 | 6 | 1 | 2 | 2 | 5 | 1 | 5 | 1 | 6 | 6 | 2 | 6 | 6 | 6 | 1 | 6 |
| 21 | 4 | 3 | 4 | 4 | 3 | 2 | 3 | 4 | 3 | 2 | 2 | 3 | 4 | 4 | 3 | 4 | 5 | 5 | 2 | 4 |
| 22 | 3 | 6 | 5 | 3 | 2 | 2 | 2 | 4 | 3 | 4 | 2 | 5 | 3 | 5 | 3 | 2 | 2 | 2 | 2 | 1 |
| 23 | 0 | 0 | 1 | 0 | 1 | 3 | 1 | 0 | 0 | 2 | 0 | 1 | 0 | 0 | 2 | 0 | 0 | 0 | 1 | 0 |
| 24 | 3 | 4 | 3 | 4 | 3 | 6 | 2 | 0 | 3 | 5 | 2 | 3 | 1 | 1 | 5 | 3 | 2 | 3 | 4 | 4 |
| 25 | 0 | 2 | 5 | 2 | 2 | 2 | 3 | 1 | 0 | 2 | 0 | 2 | 1 | 0 | 2 | 0 | 0 | 1 | 1 | 2 |
| 26 | 1 | 0 | 0 | 1 | 1 | 3 | 1 | 0 | 1 | 2 | 0 | 0 | 1 | 0 | 0 | 0 | 0 | 0 | 0 | 1 |
| 27 | 1 | 2 | 3 | 3 | 1 | 2 | 2 | 0 | 1 | 3 | 0 | 1 | 2 | 1 | 3 | 1 | 1 | 2 | 3 | 1 |
| 28 | 1 | 6 | 3 | 5 | 4 | 3 | 5 | 2 | 6 | 3 | 3 | 4 | 3 | 5 | 5 | 2 | 3 | 4 | 2 | 3 |
| 29 | 4 | 4 | 3 | 4 | 3 | 2 | 3 | 4 | 4 | 3 | 4 | 4 | 2 | 4 | 3 | 4 | 4 | 4 | 2 | 4 |
| 30 | 5 | 4 | 0 | 0 | 3 | 0 | 0 | 6 | 4 | 0 | 6 | 2 | 5 | 5 | 1 | 5 | 5 | 2 | 0 | 2 |
| 31 | 1 | 1 | 0 | 1 | 0 | 0 | 0 | 0 | 2 | 5 | 0 | 1 | 0 | 0 | 3 | 0 | 0 | 0 | 4 | 0 |
| 32 | 2 | 3 | 1 | 1 | 1 | 2 | 4 | 3 | 3 | 2 | 2 | 6 | 3 | 2 | 3 | 4 | 4 | 2 | 2 | 3 |
| 33 | 0 | 3 | 6 | 2 | 2 | 3 | 5 | 0 | 1 | 3 | 0 | 1 | 3 | 0 | 4 | 1 | 1 | 1 | 5 | 1 |
| 34 | 5 | 4 | 0 | 1 | 5 | 1 | 1 | 6 | 6 | 1 | 6 | 2 | 5 | 6 | 2 | 6 | 6 | 6 | 1 | 5 |
| 35 | 5 | 4 | 0 | 3 | 4 | 0 | 1 | 5 | 3 | 0 | 5 | 0 | 1 | 3 | 0 | 6 | 4 | 3 | 0 | 1 |
| 36 | 3 | 2 | 5 | 6 | 3 | 5 | 6 | 1 | 3 | 5 | 1 | 5 | 5 | 4 | 6 | 1 | 1 | 1 | 6 | 1 |

TOM AND MARY ARE FRIENDLY
Circumstances 21 to 40

| | 21 | 22 | 23 | 24 | 25 | 26 | 27 | 28 | 29 | 30 | 31 | 32 | 33 | 34 | 35 | 36 | 37 | 38 | 39 | 40 |
|---|---|---|---|---|---|---|---|---|---|---|---|---|---|---|---|---|---|---|---|---|
| 1 | 4 | 5 | 4 | 4 | 2 | 4 | 3 | 1 | 2 | 4 | 4 | 3 | 4 | 0 | 5 | 5 | 4 | 4 | 4 | 5 |
| 2 | 2 | 3 | 2 | 3 | 3 | 2 | 3 | 2 | 2 | 2 | 3 | 2 | 2 | 2 | 2 | 2 | 5 | 2 | 3 | 4 |
| 3 | 3 | 3 | 4 | 5 | 2 | 4 | 3 | 1 | 3 | 4 | 5 | 4 | 5 | 0 | 6 | 6 | 4 | 5 | 5 | 6 |
| 4 | 2 | 1 | 1 | 1 | 0 | 0 | 1 | 0 | 0 | 0 | 1 | 1 | 0 | 0 | 3 | 1 | 1 | 1 | 1 | 1 |
| 5 | 5 | 6 | 5 | 5 | 1 | 4 | 5 | 1 | 3 | 6 | 6 | 5 | 4 | 0 | 4 | 5 | 4 | 4 | 4 | 5 |
| 6 | 3 | 3 | 4 | 5 | 3 | 5 | 5 | 1 | 3 | 3 | 5 | 4 | 4 | 0 | 5 | 4 | 3 | 3 | 4 | 5 |
| 7 | 3 | 2 | 1 | 1 | 0 | 0 | 3 | 0 | 1 | 0 | 4 | 1 | 0 | 0 | 4 | 6 | 2 | 2 | 1 | 3 |
| 8 | 5 | 4 | 3 | 4 | 5 | 6 | 5 | 2 | 3 | 5 | 5 | 4 | 2 | 1 | 6 | 3 | 6 | 5 | 5 | 5 |
| 9 | 6 | 6 | 6 | 6 | 3 | 5 | 6 | 1 | 4 | 6 | 6 | 6 | 5 | 0 | 5 | 4 | 3 | 4 | 2 | 5 |
| 10 | 5 | 5 | 4 | 4 | 2 | 3 | 6 | 1 | 2 | 5 | 5 | 4 | 4 | 0 | 6 | 5 | 5 | 4 | 3 | 4 |
| 11 | 4 | 3 | 4 | 2 | 2 | 1 | 5 | 2 | 3 | 4 | 3 | 2 | 4 | 3 | 4 | 2 | 4 | 3 | 4 | 1 |
| 12 | 2 | 1 | 1 | 2 | 5 | 3 | 0 | 3 | 6 | 0 | 2 | 5 | 3 | 6 | 0 | 0 | 1 | 2 | 6 | 0 |
| 13 | 2 | 2 | 0 | 1 | 0 | 0 | 0 | 0 | 0 | 0 | 2 | 1 | 0 | 0 | 2 | 4 | 0 | 0 | 0 | 0 |
| 14 | 2 | 2 | 1 | 1 | 0 | 0 | 3 | 0 | 0 | 1 | 2 | 1 | 1 | 0 | 3 | 4 | 1 | 2 | 2 | 0 |
| 15 | 4 | 4 | 3 | 3 | 5 | 3 | 3 | 6 | 2 | 3 | 4 | 3 | 3 | 5 | 4 | 5 | 3 | 5 | 5 | 4 |
| 16 | 5 | 4 | 4 | 3 | 4 | 3 | 4 | 3 | 2 | 4 | 3 | 2 | 4 | 2 | 4 | 3 | 3 | 5 | 4 | 3 |
| 17 | 2 | 2 | 1 | 2 | 6 | 3 | 0 | 5 | 6 | 0 | 2 | 5 | 3 | 5 | 0 | 1 | 2 | 3 | 6 | 1 |
| 18 | 4 | 4 | 4 | 4 | 2 | 2 | 4 | 1 | 3 | 4 | 4 | 3 | 5 | 0 | 3 | 4 | 4 | 2 | 4 | 5 |
| 19 | 6 | 6 | 6 | 6 | 3 | 6 | 6 | 3 | 5 | 5 | 6 | 6 | 6 | 2 | 4 | 5 | 5 | 5 | 4 | 6 |
| 20 | 2 | 1 | 1 | 2 | 6 | 3 | 2 | 6 | 6 | 0 | 2 | 5 | 3 | 5 | 0 | 0 | 1 | 3 | 6 | 0 |
| 21 | 3 | 5 | 3 | 3 | 4 | 4 | 4 | 3 | 4 | 3 | 3 | 3 | 6 | 4 | 2 | 2 | 5 | 4 | 3 | 4 |
| 22 | 2 | 2 | 3 | 4 | 4 | 5 | 3 | 3 | 3 | 3 | 4 | 3 | 2 | 4 | 2 | 3 | 5 | 3 | 3 | 3 |
| 23 | 2 | 1 | 0 | 0 | 0 | 0 | 1 | 0 | 0 | 0 | 1 | 0 | 0 | 0 | 1 | 1 | 1 | 0 | 0 | 0 |
| 24 | 4 | 3 | 5 | 6 | 3 | 6 | 5 | 1 | 4 | 4 | 5 | 6 | 5 | 0 | 4 | 5 | 4 | 3 | 5 | 6 |
| 25 | 3 | 3 | 5 | 1 | 0 | 2 | 1 | 1 | 1 | 2 | 2 | 2 | 1 | 0 | 4 | 3 | 2 | 1 | 1 | 3 |
| 26 | 2 | 0 | 0 | 0 | 0 | 0 | 0 | 0 | 0 | 0 | 1 | 0 | 0 | 0 | 0 | 3 | 0 | 0 | 0 | 0 |
| 27 | 3 | 2 | 3 | 2 | 1 | 1 | 2 | 0 | 0 | 1 | 2 | 2 | 2 | 1 | 4 | 3 | 3 | 2 | 3 | 1 |
| 28 | 4 | 4 | 5 | 3 | 6 | 1 | 3 | 5 | 4 | 3 | 3 | 2 | 5 | 2 | 4 | 6 | 5 | 6 | 3 | 1 |
| 29 | 2 | 2 | 3 | 4 | 5 | 5 | 4 | 5 | 5 | 3 | 3 | 3 | 4 | 4 | 2 | 2 | 2 | 1 | 3 | 2 |
| 30 | 0 | 1 | 0 | 1 | 4 | 1 | 0 | 5 | 2 | 0 | 0 | 1 | 1 | 6 | 0 | 0 | 2 | 1 | 1 | 0 |
| 31 | 2 | 0 | 0 | 1 | 1 | 1 | 0 | 0 | 1 | 0 | 1 | 3 | 1 | 0 | 3 | 4 | 1 | 0 | 2 | 0 |
| 32 | 3 | 4 | 3 | 3 | 3 | 4 | 4 | 3 | 5 | 2 | 3 | 2 | 6 | 1 | 3 | 2 | 6 | 2 | 1 | 2 |
| 33 | 5 | 5 | 6 | 3 | 2 | 2 | 6 | 0 | 1 | 6 | 4 | 3 | 3 | 1 | 5 | 3 | 3 | 2 | 4 | 3 |
| 34 | 2 | 2 | 2 | 3 | 5 | 3 | 0 | 6 | 5 | 0 | 2 | 5 | 3 | 6 | 0 | 0 | 2 | 6 | 5 | 2 |
| 35 | 0 | 1 | 1 | 0 | 3 | 0 | 0 | 2 | 2 | 0 | 0 | 1 | 1 | 5 | 0 | 0 | 2 | 1 | 1 | 0 |
| 36 | 6 | 5 | 4 | 5 | 2 | 1 | 4 | 1 | 1 | 5 | 3 | 5 | 2 | 1 | 5 | 2 | 4 | 6 | 5 | 1 |

JOE AND JANE ARE UNFRIENDLY
Circumstances 1 to 20

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | 5 | 4 | 4 | 4 | 6 | 4 | 5 | 4 | 5 | 4 | 5 | 2 | 5 | 4 | 4 | 4 | 4 | 4 | 4 | 5 |
| 2 | 2 | 3 | 3 | 2 | 3 | 1 | 4 | 3 | 3 | 2 | 3 | 1 | 0 | 4 | 3 | 3 | 4 | 3 | 2 | 2 |
| 3 | 6 | 6 | 6 | 4 | 5 | 4 | 4 | 3 | 6 | 6 | 3 | 1 | 4 | 4 | 4 | 4 | 4 | 4 | 4 | 4 |
| 4 | 5 | 3 | 5 | 3 | 1 | 2 | 3 | 1 | 0 | 3 | 0 | 0 | 1 | 0 | 2 | 0 | 1 | 1 | 3 | 3 |
| 5 | 6 | 6 | 5 | 5 | 6 | 5 | 6 | 5 | 5 | 5 | 4 | 0 | 5 | 5 | 6 | 4 | 6 | 5 | 5 | 6 |

-continued

JOE AND JANE ARE UNFRIENDLY
Circumstances 1 to 20

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 6 | 4 | 5 | 4 | 4 | 4 | 5 | 6 | 2 | 6 | 5 | 4 | 1 | 4 | 3 | 5 | 4 | 3 | 5 | 4 | 5 |
| 7 | 4 | 4 | 5 | 4 | 1 | 6 | 5 | 1 | 1 | 3 | 0 | 0 | 5 | 4 | 5 | 4 | 3 | 6 | 6 | 6 |
| 8 | 5 | 5 | 5 | 4 | 5 | 3 | 5 | 5 | 5 | 4 | 5 | 1 | 3 | 4 | 4 | 3 | 2 | 3 | 4 | 2 |
| 9 | 3 | 4 | 6 | 2 | 2 | 5 | 4 | 2 | 5 | 5 | 2 | 1 | 4 | 3 | 5 | 5 | 2 | 3 | 4 | 4 |
| 10 | 4 | 4 | 5 | 4 | 5 | 5 | 6 | 3 | 3 | 5 | 4 | 1 | 4 | 6 | 5 | 5 | 3 | 4 | 5 | 5 |
| 11 | 2 | 3 | 3 | 2 | 3 | 3 | 3 | 4 | 1 | 4 | 5 | 3 | 4 | 5 | 3 | 6 | 5 | 4 | 4 | 3 |
| 12 | 1 | 0 | 0 | 1 | 2 | 0 | 0 | 0 | 0 | 0 | 1 | 4 | 0 | 0 | 1 | 1 | 0 | 0 | 0 | 0 |
| 13 | 0 | 1 | 2 | 1 | 2 | 3 | 4 | 1 | 2 | 4 | 0 | 0 | 6 | 2 | 4 | 2 | 2 | 6 | 6 | 5 |
| 14 | 3 | 4 | 5 | 4 | 4 | 6 | 4 | 1 | 3 | 6 | 2 | 0 | 6 | 2 | 6 | 3 | 3 | 6 | 6 | 6 |
| 15 | 3 | 5 | 4 | 5 | 6 | 4 | 4 | 6 | 4 | 4 | 4 | 3 | 5 | 5 | 3 | 2 | 3 | 5 | 3 | 4 |
| 16 | 2 | 5 | 3 | 2 | 4 | 3 | 2 | 5 | 2 | 4 | 3 | 1 | 1 | 2 | 3 | 4 | 2 | 3 | 5 | 3 |
| 17 | 3 | 1 | 0 | 3 | 2 | 1 | 0 | 0 | 1 | 0 | 1 | 5 | 0 | 3 | 1 | 2 | 1 | 1 | 0 | 0 |
| 18 | 4 | 4 | 4 | 5 | 5 | 4 | 5 | 4 | 4 | 4 | 5 | 1 | 4 | 4 | 5 | 5 | 6 | 3 | 3 | 5 |
| 19 | 5 | 5 | 4 | 6 | 5 | 4 | 5 | 6 | 5 | 5 | 5 | 3 | 5 | 5 | 5 | 6 | 6 | 5 | 4 | 4 |
| 20 | 1 | 1 | 0 | 2 | 2 | 1 | 0 | 0 | 0 | 0 | 1 | 4 | 0 | 1 | 0 | 1 | 0 | 0 | 0 | 0 |
| 21 | 3 | 3 | 3 | 5 | 4 | 2 | 2 | 4 | 3 | 2 | 6 | 5 | 3 | 5 | 3 | 6 | 5 | 3 | 1 | 1 |
| 22 | 2 | 2 | 2 | 2 | 2 | 1 | 2 | 2 | 4 | 2 | 3 | 1 | 3 | 3 | 2 | 2 | 3 | 2 | 2 | 2 |
| 23 | 0 | 2 | 3 | 3 | 2 | 4 | 3 | 1 | 1 | 5 | 0 | 0 | 1 | 0 | 4 | 2 | 1 | 1 | 4 | 3 |
| 24 | 4 | 6 | 4 | 5 | 5 | 4 | 3 | 2 | 6 | 5 | 5 | 0 | 5 | 6 | 4 | 5 | 5 | 4 | 3 | 3 |
| 25 | 1 | 2 | 4 | 2 | 2 | 2 | 3 | 1 | 1 | 4 | 0 | 0 | 2 | 1 | 1 | 1 | 1 | 1 | 2 | 0 |
| 26 | 6 | 1 | 2 | 2 | 4 | 6 | 2 | 0 | 1 | 3 | 0 | 0 | 6 | 0 | 1 | 0 | 2 | 4 | 1 | 5 |
| 27 | 1 | 3 | 4 | 3 | 1 | 1 | 3 | 2 | 4 | 3 | 3 | 1 | 3 | 1 | 2 | 2 | 1 | 1 | 2 | 1 |
| 28 | 2 | 2 | 3 | 1 | 3 | 3 | 3 | 5 | 3 | 3 | 5 | 4 | 3 | 3 | 3 | 3 | 4 | 1 | 3 | 2 |
| 29 | 2 | 2 | 2 | 2 | 2 | 2 | 1 | 3 | 4 | 2 | 6 | 6 | 2 | 2 | 2 | 2 | 2 | 2 | 1 | 1 |
| 30 | 2 | 1 | 0 | 2 | 2 | 0 | 0 | 2 | 0 | 0 | 1 | 6 | 0 | 2 | 0 | 1 | 0 | 0 | 0 | 0 |
| 31 | 2 | 2 | 1 | 6 | 0 | 0 | 0 | 0 | 1 | 6 | 0 | 0 | 1 | 0 | 6 | 3 | 4 | 1 | 5 | 1 |
| 32 | 3 | 3 | 2 | 3 | 2 | 2 | 2 | 4 | 3 | 2 | 6 | 5 | 1 | 3 | 3 | 5 | 5 | 2 | 1 | 1 |
| 33 | 2 | 3 | 6 | 3 | 3 | 2 | 2 | 2 | 2 | 3 | 2 | 1 | 2 | 1 | 3 | 3 | 2 | 2 | 5 | 1 |
| 34 | 1 | 1 | 0 | 2 | 2 | 1 | 0 | 2 | 0 | 0 | 3 | 6 | 0 | 2 | 0 | 1 | 1 | 0 | 0 | 0 |
| 35 | 0 | 0 | 0 | 0 | 1 | 0 | 0 | 2 | 0 | 0 | 1 | 5 | 0 | 1 | 0 | 1 | 0 | 0 | 0 | 0 |
| 36 | 1 | 2 | 2 | 1 | 3 | 3 | 3 | 6 | 3 | 5 | 4 | 2 | 3 | 6 | 3 | 2 | 1 | 1 | 5 | 2 |

JOE AND JANE ARE UNFRIENDLY
Circumstances 21 to 40

| | 21 | 22 | 23 | 24 | 25 | 26 | 27 | 28 | 29 | 30 | 31 | 32 | 33 | 34 | 35 | 36 | 37 | 38 | 39 | 40 |
|---|---|---|---|---|---|---|---|---|---|---|---|---|---|---|---|---|---|---|---|---|
| 1 | 5 | 5 | 4 | 5 | 1 | 3 | 5 | 5 | 5 | 4 | 6 | 5 | 5 | 2 | 4 | 5 | 2 | 4 | 5 | 1 |
| 2 | 3 | 3 | 2 | 3 | 2 | 3 | 2 | 2 | 3 | 4 | 1 | 2 | 3 | 2 | 1 | 1 | 3 | 3 | 2 | 5 |
| 3 | 4 | 4 | 4 | 4 | 2 | 3 | 6 | 6 | 2 | 3 | 5 | 3 | 4 | 3 | 4 | 4 | 2 | 6 | 6 | 1 |
| 4 | 3 | 2 | 3 | 2 | 0 | 1 | 4 | 4 | 2 | 3 | 1 | 2 | 1 | 1 | 3 | 1 | 0 | 1 | 0 | 0 |
| 5 | 5 | 6 | 5 | 6 | 1 | 1 | 5 | 5 | 5 | 2 | 5 | 3 | 5 | 2 | 5 | 5 | 0 | 4 | 3 | 2 |
| 6 | 5 | 5 | 5 | 5 | 1 | 1 | 5 | 5 | 5 | 2 | 6 | 6 | 5 | 3 | 5 | 5 | 0 | 4 | 4 | 2 |
| 7 | 4 | 5 | 3 | 2 | 0 | 1 | 3 | 3 | 3 | 2 | 4 | 5 | 2 | 1 | 5 | 5 | 0 | 2 | 1 | 0 |
| 8 | 5 | 5 | 3 | 5 | 4 | 4 | 4 | 6 | 4 | 5 | 4 | 3 | 3 | 5 | 4 | 4 | 4 | 6 | 5 | 3 |
| 9 | 5 | 6 | 6 | 5 | 1 | 2 | 6 | 3 | 4 | 6 | 4 | 3 | 4 | 3 | 5 | 4 | 0 | 5 | 3 | 1 |
| 10 | 6 | 6 | 6 | 4 | 2 | 2 | 6 | 6 | 3 | 6 | 4 | 5 | 5 | 2 | 6 | 5 | 1 | 5 | 4 | 1 |
| 11 | 2 | 2 | 3 | 2 | 1 | 2 | 3 | 2 | 2 | 3 | 3 | 2 | 5 | 3 | 3 | 3 | 4 | 5 | 3 | 2 |
| 12 | 0 | 0 | 0 | 0 | 5 | 5 | 0 | 0 | 5 | 0 | 0 | 0 | 0 | 1 | 0 | 0 | 4 | 1 | 1 | 0 |
| 13 | 4 | 3 | 1 | 2 | 0 | 0 | 2 | 2 | 2 | 1 | 5 | 4 | 0 | 0 | 3 | 5 | 0 | 1 | 0 | 0 |
| 14 | 6 | 5 | 5 | 5 | 0 | 1 | 5 | 5 | 2 | 3 | 5 | 6 | 3 | 1 | 6 | 6 | 0 | 3 | 1 | 0 |
| 15 | 4 | 3 | 1 | 2 | 6 | 6 | 3 | 3 | 5 | 2 | 4 | 3 | 3 | 4 | 2 | 4 | 6 | 4 | 4 | 1 |
| 16 | 4 | 2 | 4 | 3 | 2 | 3 | 3 | 3 | 3 | 5 | 1 | 2 | 3 | 4 | 5 | 4 | 2 | 5 | 3 | 1 |
| 17 | 0 | 0 | 0 | 1 | 6 | 6 | 0 | 0 | 6 | 0 | 0 | 0 | 1 | 2 | 0 | 0 | 5 | 2 | 1 | 6 |
| 18 | 4 | 4 | 5 | 5 | 2 | 1 | 4 | 5 | 3 | 4 | 3 | 4 | 6 | 3 | 4 | 4 | 3 | 4 | 3 | 2 |
| 19 | 4 | 4 | 4 | 6 | 2 | 1 | 4 | 4 | 4 | 5 | 6 | 5 | 6 | 4 | 3 | 3 | 3 | 5 | 6 | 4 |
| 20 | 0 | 0 | 0 | 1 | 5 | 5 | 0 | 0 | 6 | 0 | 0 | 0 | 0 | 1 | 0 | 0 | 4 | 2 | 0 | 1 |
| 21 | 3 | 1 | 2 | 3 | 3 | 4 | 2 | 2 | 4 | 5 | 2 | 2 | 4 | 5 | 2 | 2 | 3 | 4 | 3 | 6 |
| 22 | 0 | 0 | 0 | 1 | 5 | 5 | 0 | 0 | 6 | 0 | 0 | 0 | 0 | 1 | 0 | 0 | 4 | 2 | 0 | 1 |
| 23 | 3 | 1 | 2 | 3 | 3 | 4 | 2 | 2 | 4 | 5 | 2 | 2 | 4 | 5 | 2 | 2 | 3 | 4 | 3 | 6 |
| 24 | 5 | 3 | 5 | 6 | 1 | 2 | 5 | 4 | 5 | 3 | 3 | 6 | 4 | 4 | 4 | 4 | 2 | 1 | 6 | 2 |
| 25 | 3 | 4 | 3 | 2 | 0 | 0 | 4 | 4 | 1 | 4 | 2 | 2 | 3 | 2 | 2 | 3 | 0 | 2 | 2 | 1 |
| 26 | 3 | 2 | 0 | 1 | 1 | 0 | 0 | 0 | 3 | 0 | 4 | 4 | 0 | 0 | 2 | 6 | 0 | 0 | 0 | 0 |
| 27 | 2 | 3 | 3 | 3 | 1 | 1 | 4 | 4 | 2 | 2 | 3 | 2 | 3 | 2 | 3 | 3 | 1 | 3 | 2 | 1 |
| 28 | 4 | 3 | 4 | 2 | 5 | 3 | 3 | 3 | 3 | 5 | 3 | 2 | 3 | 6 | 3 | 4 | 6 | 5 | 4 | 2 |
| 29 | | 1 | 1 | 2 | 2 | 4 | 2 | 2 | 3 | 4 | 2 | 2 | 4 | 6 | 1 | 1 | 4 | 4 | 3 | 6 |
| 30 | 0 | 0 | 0 | 0 | 5 | 4 | 0 | 0 | 5 | 0 | 0 | 0 | 0 | 3 | 0 | 0 | 5 | 1 | 0 | 2 |
| 31 | 4 | 0 | 1 | 4 | 1 | 0 | 3 | 4 | 3 | 1 | 2 | 4 | 4 | 2 | 2 | 4 | 0 | 1 | 3 | 0 |
| 32 | 0 | 2 | 1 | 1 | 3 | 4 | 2 | 2 | 3 | 4 | 1 | 2 | 5 | 6 | 1 | 1 | 3 | 3 | 1 | 5 |
| 33 | 3 | 4 | 6 | 3 | 1 | 2 | 4 | 3 | 1 | 6 | 2 | 3 | 1 | 1 | 4 | 4 | 1 | 3 | 3 | 1 |
| 34 | 0 | 0 | 0 | 1 | 6 | 6 | 0 | 0 | 6 | 0 | 0 | 0 | 1 | 3 | 0 | 0 | 6 | 4 | 1 | 4 |
| 35 | 0 | 0 | 0 | 0 | 4 | 5 | 0 | 0 | 0 | 0 | 0 | 0 | 0 | 3 | 0 | 0 | 5 | 0 | 1 | 1 |
| 36 | 6 | 5 | 2 | 4 | 2 | 2 | 3 | 3 | 2 | 3 | 1 | 5 | 2 | 2 | 1 | 3 | 5 | 6 | 4 | 1 |

In the charts set forth above, the numbers 1 through 40 represent circumstances while the numbers 1 through 36 represent reactions.

For the performance ratings above, the description of circumstances and reactions are as follows:

CIRCUMSTANCES

MARY (JANE) - AGES 9 TO 10

(1) Mary's (Jane's) older brother laughingly says, "You got me in trouble by telling on me."

(2) A few weeks after Mary's (Jane's) mother remarried, her stepdad says, "You can call me dad."

(3) When Mary (Jane) tells her dad she got an (A) grade in math, he nods and continues to read the paper.

(4) Mary's (Jane's) stepsister says, "Your mother treats you better than she treats me."

(5) A new boy at school playfully pulls Mary's (Jane's) hair and it hurts.

(6) Mary (Jane) sees her little sister reading her diary.

(7) A friend has a birthday party and does not invite Mary (Jane) and a few other girls. The next day she meets her friend in the hallway at school.

(8) The teacher likes Mary's (Jane's) poem best and asks her to read the poem in front of class.

(9) Mary (Jane) tells a friend she had never stolen anything. Her friend replies, "I stole this VCR tape."*

(10) Mary (Jane) hears her best friend tell someone a secret she had told her friend.

TOM (JOE) AGES 11 TO 12

(11) Tom's (Joe's) dad unexpectedly says, "You like waterskiing so we are sending you to a ski camp."

(12) Tom's (Joe's) best friend introduces him to a new friend who is of a different race and color.

(13) A teammate suddenly pulls the baseball bat out of Tom's (Joe's) hand.

(14) A girl from school keeps following Tom (Joe) around.

(15) A neighbor tells Tom (Joe), "Keep your dog out of my yard."

(16) Tom (Joe) is repairing his bicycle when his dad calls, "Round up the kids and we will go out for ice cream."

(17) Tom's (Joe's) sister smiles and asks, "May I borrow your skateboard."

(18) Tom (Joe) is lying on the floor doing his homework when his baby brother sits on his book.

(19) Tom (Joe) does not know the answer to a teacher's question and stutters. A classmate laughs.

(20) When Tom (Joe) laughs at his sister, she frowns and steps on his toe.

MARY (JANE) AGES 13 TO 14

(21) Mary (Jane) wears a new dress to a party and a friend says, "I do not like your dress."

(22) Mary (Jane) enjoyed eating lunch with Al and his friends at the school cafeteria. The next day she sees Al eating lunch with another girl.

(23) Mary (Jane) asks about buying a new outfit and her mother says, "We can not afford it now."

(24) Mary (Jane) tells a friend that, "Sex should be reserved for marriage," and her girlfriend laughs.

(25) Susan whispers to Mary (Jane), "My parents are away and I am inviting a few boys to my house."

(26) When Mary (Jane) says, "Why, that is a lie!" Liz replies, "I would rather tell my parents a lie than tell them what really happened."

(27) Mary's (Jane's) friend has her first date. Mary (Jane) asks her mother about dating and she says, "Wait until you are sixteen."

(28) Mary's (Jane's) mother unexpectedly says, "I hope you like Ray. We are thinking about getting married."

(29) Mary (Jane) is talking to a girlfriend on the phone when her brother interrupts and says, "It is my turn, you have been talking for fifteen minutes."

(30) Mary (Jane) tries out to be a cheerleader and is told she can only be a standby this year.

TOM (JOE) AGES 15 TO 17

(31) A friend tells Tom (Joe), I kissed your girlfriend at the party.

(32) Tom (Joe) tells a friend he has a date with Jan and his friend replies, "I think she is fat."

(33) Tom (Joe) is shooting baskets when his mother asks him to drive his younger sister to a gymnastics class.

(34) Tom's (Joe's) dad says, "If you drop by the office, I will take you out to lunch."

(35) Tom (Joe) is arguing with his sister when his mother punishes him without knowing why the argument started.

(36) The school bully tells Tom (Joe), "I just beat up your best friend."

(37) In his new school in Chicago, Tom (Joe) sees many students of different races and colors. One pretty girl he hardly knows, who is of a different race, smiles and says, "Hello."*

(38) Tom (Joe) is kissing his girlfriend in the front seat of the car when her dad opens the car door.

(39) Tom (Joe) makes new friends and begins to make poor grades. One of his friends says, "Why don't we drop out and have fun?"*

(40) Tom (Joe) transfers to a new school and for the first time sees a boy of a different race and color walking hand in hand with a girl he knows.*

REACTIONS

1. Says, "Nuts!"
2. Looks away and ignores
3. Thinks, "That's ridiculous."
4. Becomes sullen
5. Looks unhappy
6. Feels like arguing
7. Thinks, "I don't like you."
8. Feels confused
9. Is disappointed
10. Feels frustrated
11. Thinks, "Why me"
12. Grins and pretends to hit
13. Thinks, "I will get even with you."
14. Looks angry
15. Feels excited
16. Wishes he or she were someplace else
17. Is amused
18. Groans
19. Frowns
20. Teases
21. Shrugs
22. Is puzzled
23. Thinks, "I hate you."
24. Disagrees
25. Feels sad
26. Hits or shoves
27. Feels helpless 28. Thinks, "Now what do I do?"
29. Thoughtfully pauses
30. Looks happy
31. Thinks, "Why don't you shut up!"
32. Nods indifferently
33. Feels discouraged
34. Smiles
35. Thinks, "I like you."
36. Feels embarrassed In the performance rating charts given above, the numbers representing the performance ratings are arranged in a matrix wherein the circumstance variables are grouped by columns vertically and the reaction variables are grouped in horizontal rows. As shown in FIGS. 1 and 2, the ratings are again set forth in matrix form, this time on chart discs 8 with one set of variables grouped along a plurality of radial lines and the other set of variables grouped along a plurality of concentric circles. If desired, the charts may be printed directly on the board, or as shown in FIGS. 1 and 2, the charts may be printed on discs 8 which are mounted to rotate on pins 10. Alternatively, the charts may be printed on one disc (one chart on one side and the other chart on the other side) which is separate from the game board. Such disc would be supplied with the game. Turning back to FIG. 1, it is noted that there are 40 radial lines corresponding to the 40 columns of numbers for the circumstance variables in the charts above, and there are 36 concentric circles of numbers corresponding to the 36 reaction variable ratings listed on the charts.

The mechanism for determining the performance rating will now be described. Referring to FIGS. 1 and 2, there is shown a template disc 12 coaxially positioned over a chart disc 8 containing the performance ratings. The template disc 12 pivots about pivot pin 10. Disc 12 carries a number of radial lines 14. There are as many radial lines 14 as there are concentric circles of numbers on the chart of disc 8—namely 36. The disc 12 is provided with window means through which the performance ratings can be read. In the embodiment shown in FIG. 1, the window means is a slot 16 having a spiral configuration. Alternatively, the window means can take the form of a plurality of openings or holes 18 arranged in a spiral, there being an opening on each of the radial lines as shown in FIG. 2.

In the case of spiral slot 16, the slot is wide enough to read a performance rating number through it when it is properly registered with respect to the chart disc 8 below it. The situation ratings may be plotted on the disc 8 in the same manner as is described in my previous U.S. Pat. No. 3,124,358. In the alternative form in which the window means comprises a plurality of holes 18 arranged in a spiral, each hole is large enough to permit a player to read a performance rating number through it, again, when the template disc 12 is properly oriented with respect to the chart disc 8 below it.

It should be pointed out at this time how the spiral is determined. This is shown on the "Joe and Jane are unfriendly" part of FIG. 1. Reference was made above to the fact that disc 12 is provided with a number of radial lines 14. These lines are equally spaced and are equal in number to the number of concentric circles or performance rating numbers (on the chart on disc 8). In addition, for the purpose of plotting the spiral, disc 12 is ruled with a number of equally spaced concentric circles, these being equal in number to the number of radial lines.

With disc 12 provided with the proper number of radial lines and an equal number of concentric circles as set forth above, the radial lines are preferably numbered ordinally at the periphery of the disc. Thus, in the embodiment shown, the radial lines are numbered 1 through 36. (Some of these numbers appear in FIG. 2). Then, an "x" or other identification means is placed at the intersection of radial line 1 with the outermost concentric circle, which we may call circle number 1. Similarly, an "x" is placed at the intersection of radial line 2 with the next circle, and so forth until each radial line is marked where it intersects its corresponding circle. The points thus plotted determine the location of the spiral, and the width of the spiral slot (if a slot is used as shown at 16 in FIG. 1) is made sufficient to permit easy reading of a number through the slot. If a plurality of holes 18 are used (see FIG. 2) the holes are placed at the intersection points identified above; again, the holes are made large enough to permit the easy reading of performance ratings numbers therethrough.

In the preferred form of the game, the radial lines appear as shown at 14 on the template disc 12—at least the portion from the periphery of the disc inward as far as the window means because, in the embodiment shown, these radial lines extending inward to the window means constitute means to isolate a row (or at least a portion of a row) of one of the two sets of rows of performance rating numbers. It is not necessary, and probably not desirable, to have the concentric circles appear in the game in its finished form. The circles are shown in FIG. 1 in order to make clear how the spiral is plotted.

The concentric circles used to plot the spiral on disc 12 are coincident with the concentric circles which establish one set of the rows of performance rating numbers which appear in the chart shown on disc 8. The reason for this is that the numbers are read through the window means in the disc 12.

Just as the radial lines 14 constitute means to isolate at least a portion of a row of one of the two sets of rows, the game mechanism also provides additional means cooperating with the isolated row (or portion) to indicate a single performance rating. In FIGS. 1 and 2, this additional means is the window means having the spiral configuration and discussed in detail above.

The game additionally includes a plurality of different and distinguishable tokens which are selected by and represent the individual players and which are movable on track 4. Such tokens may take any desired form, as for example a miniature baseball bat as shown at 20, a miniature airplane as shown at 24 and so forth in as many numbers as are expected to play the game. Or, a plurality of tokens similar to that shown at 26 may be provided in different colors.

OPERATION

Generally speaking, the game is played by the player advancing their tokens in turn around the track a preagreed number of times, with the first person to finish being declared the winner. Each player is required to play a friendly person on the first turn and then an unfriendly person on the second turn. On all following turns, each player is allowed to choose to play either a friendly or an unfriendly person.

To begin play, the players are dealt an equal number of playing cards (see FIG. 3). Each player begins at space 1 of the track, with the order of play determined in any suitable random fashion. The situation assigned to space 1 is as follows: "Mary's (Jane's) older brother laughingly says, 'You got me in trouble by telling on me.'" The player starting first examines his cards and decides which reaction is most appropriate for the circumstance set forth in space 1. The player then selects that card which the player judges to be the most likely reaction of the hypothetical person "Mary". It should be kept in mind that each hypothetical person is assigned a set of character traits which are not disclosed to the players. However, as the game proceeds, the disclosure of the performance ratings of various reaction-circumstance pairings allow the players to discover the specific character traits which were assigned to each hypothetical person. The above discovery of the character trait assignment relative to the various hypothetical persons tends to aid the players in their goal of selecting the most appropriate reaction for the next given circumstance.

Using the "Joe and Jane are unfriendly" set of discs, the player grasps the outer edge of the bottom disc between his thumb and forefinger and turns the bottom disc until the number of the track space occupied by his token is opposite either arrow 28 or arrow 30, whichever is more convenient. For purposes of illustration, reference is here made to the enlarged fragmentary elevational view shown in FIG. 2. Everybody starts on space 1. Let it now be assumed that a player has advanced to space 3 on his second turn, so the hypothetical person chosen is "Jane" (recall—the player should choose an unfriendly hypothetical person on his second turn). The situation in space 3 facing the hypothetical person "Jane" is "Jane tells her dad she got an (A) grade in math, he nods and continues reading the paper." The player turns disc 8 until the number 3 on the periphery is opposite arrow 28. Let it be assumed that the player has before him the reaction cards shown in FIG. 3, and he selects "Feels like arguing" as the most likely reaction. The "Feels like arguing" card carries the number "6", so the player turns the top disc 12 until number "6" on its periphery is also aligned with arrow 28.

Following the radial line running inward from number 37 6" to the window means, the player read the performance rating number which is visible through the window means. As can be seen from FIG. 2, that number if "4." The player then advances his playing token four spaces along the track—namely from space "3" to space "7."

The player discards the card he just selected, and selects another from a supply pile in which the cards are stacked, preferably face down. Then the next player takes his turn.

If a player receives a performance rating of zero "0" for two consecutive turns, the player is allowed to move ahead 1 space after receiving that second "0" performance rating.

In order to give the player a greater variety of responses from which he may make a selection, it may be desirable to have the player discard not only the card he has just selected but also one other card, and then replace those cards by taking two cards instead of one from the supply pile.

Play for a friendly hypothetical person (i.e. "Tom" or "Mary") is similar to play for an unfriendly hypothetical person (i.e. "Joe" or "Jane") except that the player uses the "Tom and Mary are friendly" set of discs.

The game may be played by any number of individual players including only one player playing the game by himself. Also, teams of players may be selected to compete against another team.

The game is playable under a variety of rules. For example, the players may be required to go around the track twice playing a friendly hypothetical person on the first time around and an unfriendly hypothetical person on the second time around the track. Other variations will be apparent to those skilled in the art.

The present inventive psychology game has been adapted into a game board type game, however, it should be noted that the present inventive psychology game can easily be adapted into a computer type game or a syndicated newspaper column game.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of playing a psychology game with one or more players wherein, said method comprising the steps of:

(1 ) assigning one or more players a hypothetical person having at least one undisclosed character trait;

(2) selecting a description of a circumstance with which the hypothetical person is confronted;

(3) providing each player with a plurality of descriptions of possible reactions of the hypothetical person to the circumstance;

(4 ) selecting as most appropriate one or the plurality of descriptions of possible reactions to the selected circumstance;

(5) determining the quality of the player's reaction selection in the reaction selection step;

(6) rewarding the one or more players with a performance rating which is a game benefit in proportion to the quality of the player's reaction selection determined in the quality determining step; and (7) determining the at least one undisclosed character trait by comparing the player's selected circumstances and reaction selection to the circumstances to the respective performance ratings awarded to the player, whereby the determination of the at least one undisclosed character trait of the hypothetical person increases a player's ability to determine the most appropriate selection in the reaction selection step.

2. The method of claim 1 wherein the game is played on a game board having a playing track comprising a plurality of playing spaces and each of the one or more players is provided with a game token for indicating the each of the one or more players' position on the playing track and the game further comprises the step of:

advancing the game token of each of the one or more players along the playing track a number of playing spaces corresponding to the game benefit provided to the respective player in the rewarding step.

3. The method of claim 2 wherein the playing track comprises forty playing spaces.

4. The method of claim 3 wherein the one or more players are further provided with a plurality of descriptions of undisclosed character traits which may have been assigned to any of the hypothetical persons.

5. The method of claim 4 wherein some of the playing spaces contain a character trait selection indicator therein and further comprising the step of:

selecting, as having been assigned to one of the hypothetical persons, one of the plurality of character traits which may have been assigned to any of the hypothetical persons.

6. The method of claim 5 wherein the character trait selection indicator is an asterisk.

7. The method of claim 1 wherein the players are provided with four hypothetical persons each possessing at least one undisclosed character trait.

8. The method of claim 1 wherein the one or more players are further provided with a plurality of descriptions of undisclosed character traits which may have been assigned to the hypothetical person and the game further comprises the step of:

selecting which of the character traits were assigned to the hypothetical person.

9. The method of claim 1 wherein the hypothetical person has assigned to it at least ten undisclosed character traits.

10. The method of claim 9 wherein the hypothetical person has further assigned to it at least one disclosed character trait.

11. The method of claim 10 wherein the at least one disclosed character trait includes friendlY or unfriendly.

12. A method of playing a psychology game with one or more players wherein, said method comprising the steps of:

(1) assigning one or more players two or more hypothetical persons having at least one undisclosed character trait;

(2) selecting a description of a circumstance with which the hypothetical persons are confronted;

(3) providing each player with a plurality of descriptions of possible reactions of the hypothetical persons to the circumstance;

(4) selecting which one of the two or more hypothetical persons will be assumed to have been confronted with the described circumstance;

(5) selecting as most appropriate, one of the plurality of descriptions of possible reactions to the selected circumstance;

(6) determining the quality of the player's reaction selection in the reaction selection step;

(7) rewarding the one or more players with a performance rating which is a game benefit in proportion to the quality of the player's reaction selection determined in the quality determining step; and whereby the determination of the at least one undisclosed character trait of the hypothetical person increases a player's ability to determine the most appropriate selection in the reaction selection step.

13. The method of claim 12 wherein the game is played on a game board having a playing track comprising a plurality of playing spaces and each of the one or more players is provided with a game token for indicating the each of the players' position on the playing track and the game further comprises the step of:

advancing the game token of each of the one or more players along the playing track a number of playing spaces corresponding to the game benefit provided to the respective player in the rewarding step.

14. The method of claim 13 wherein the playing track comprises forty playing spaces.

15. The method of claim 14 wherein the one or more players are further provided with a plurality of descriptions of undisclosed character traits which may be assigned to any of the hypothetical persons.

16. The method of claim 15 wherein some of the playing spaces contain a character trait selection indicator therein and further comprising the step of:

selecting, as having been assigned to one of the hypothetical persons, one of the plurality of character traits which may have been assigned to any of the hypothetical persons.

17. The method of claim 16 wherein the character trait selection indicator is an asterisk.

18. The method of claim 12 wherein the one or more players are further provided with a plurality of descriptions of undisclosed character traits which may have been assigned to any of the hypothetical persons and the game further comprises the step of:

selecting which of the character traits were assigned to each of the hypothetical persons.

* * * * *

UNITED STATES PATENT AND TRADEMARK OFFICE

CERTIFICATE OF CORRECTION

PATENT NO. : 5,020,804

DATED : June 4, 1991

INVENTOR(S) : Gail H. Weedman

It is certified that error appears in the above-identified patent and that said Letters Patent is hereby corrected as shown below:

In column 15, line 43, please delete "37".
In column 15, line 43, please change "read" to --reads--.
In column 16, line 35, please change "or" to --of--.

In column 17, line 30, please change "friendlY" to --friendly--.

In column 18, line 9, please insert the following paragraph:
--(8) determining the at lease one undisclosed character trait by comparing the player's selected circumstances and reaction selection to the circumstances to the respective performance ratings awarded to the player,--.

Signed and Sealed this

Fifth Day of January, 1993

*Attest:*

DOUGLAS B. COMER

*Attesting Officer*

*Acting Commissioner of Patents and Trademarks*